US007331312B2

(12) United States Patent
Choi

(10) Patent No.: US 7,331,312 B2
(45) Date of Patent: Feb. 19, 2008

(54) WASTE HEAT RECOVERY APPARATUS AND METHOD FOR BOILER SYSTEM

(75) Inventor: Sungkyou Choi, Fullerton, CA (US)

(73) Assignee: Boiler Clinic, Inc., Buena Park, CA (US)

( * ) Notice: Subject to any disclaimer, the term of this patent is extended or adjusted under 35 U.S.C. 154(b) by 136 days.

(21) Appl. No.: 11/264,515

(22) Filed: Oct. 31, 2005

(65) Prior Publication Data

US 2007/0107674 A1 May 17, 2007

(51) Int. Cl.
*F22B 1/18* (2006.01)

(52) U.S. Cl. ..... 122/20 B; 122/7 R

(58) Field of Classification Search ..... 122/20 B, 122/7 R, 1 C, 452, 448.1; 237/16, 19
See application file for complete search history.

(56) References Cited

U.S. PATENT DOCUMENTS

| | | | | |
|---|---|---|---|---|
| 4,065,055 | A * | 12/1977 | De Cosimo | 237/12.1 |
| 4,370,949 | A * | 2/1983 | Beckett | 122/20 B |
| 4,429,661 | A * | 2/1984 | McClure | 122/20 B |
| 4,660,511 | A * | 4/1987 | Anderson | 122/420 |
| 4,693,213 | A | 9/1987 | Yanai et al. | |
| 4,799,461 | A | 1/1989 | Shigenaka et al. | |
| 4,878,457 | A * | 11/1989 | Bekedam | 122/441 |
| 6,435,138 | B2 | 8/2002 | Shimada et al. | |

* cited by examiner

*Primary Examiner*—Gregory A. Wilson
(74) *Attorney, Agent, or Firm*—Trojan Law Offices

(57) ABSTRACT

An apparatus and method for recovery of waste heat in a boiler system, wherein heat from the hot condensate water in the system, which otherwise would be lost through dissipation, is used for other applications. Particularly, the waste heat energy recovered in the form of hot condensate water can be used to heat makeup water for a hot water tank.

13 Claims, 1 Drawing Sheet

WASTE HEAT RECOVERY APPARATUS AND METHOD FOR BOILER SYSTEM

BACKGROUND OF THE INVENTION

The present invention relates to an apparatus and method for recovery of waste heat in a boiler system, and more particularly, to an apparatus and method of waste heat recovery that can be use in a hot water tank.

A boiler is a closed vessel in which water or other fluid is heated under pressure to create steam. The ability of steam to carry large amounts of thermal energy is the property that makes it an effective working fluid. The generated steam is then circulated out of the boiler for use in various process or heating applications. In a conventional boiler system, for example, water is heated under pressure in a boiler, creating steam that can be use in a process equipment such as a turbine. However, in this open system much of the heat energy can be lost during the process.

In a boiler system as described, when the properties (i.e. temperature, pressure, volume) of the working fluid is changed as a consequence of work or heat exchange, then it is said that the fluid has gone through a "process." In some processes the relationship between pressure, temperature, and volume are specified as the fluid goes from one thermodynamic state to another. The most common processes are those in which the temperature, pressure, or volume is held constant during the process. If the fluid passes through various processes and then eventually returns to the same state it began with, the system is said to have undergone a cyclic process.

In a general cyclic boiler system, the thermal efficiency of the boiler can be increased by the recovery of waste heat. In such a closed loop system, after water enters a boiler where it is heated by an external heat source to become steam, the pressurized steam can be applied to a steam-utilizing device to generate power output, for example. This results in a decrease in the temperature and pressure of the steam vapor. To recover the waste heat, the vapor is collected in a condenser where it is cooled to become saturated liquid, i.e. warm feed water. This warm feed water is then pumped back into the boiler and the cycle is repeated. Because the waste heat from the steam vapor is recycled as warm feed water back into the boiler, the thermal efficiency of the system is improved.

One method of recovering waste heat is disclosed in U.S. Pat. No. 6,196,163 to Shah. In the Shah patent, heat is recovered by capturing the hot condensate via a reactor steam jacket, and then recycling the hot condensate back into the boiler. More specifically, high temperature steam condensate is collected from a reactor steam jacket into a closed vessel in which the pressure is that of the lowest pressure in the reactor steam jacket, but higher than atmospheric, such that there is little or no steam flash over due to pressure drop. The steam condensate is then fed back into the boiler. According to Shah, the amount of heat saving to the boiler is the amount of flash over steam saved and hotter condensate returned to the boiler by this method.

However, the invention described by Shah suffers from a number of disadvantages. For instance, an elaborate system of pumps is necessary for operation in the Shah method, which is not only more costly, but also consumes extra energy to operate and thus results in decreased overall efficiency of the system. More significantly, the boiler cycle described by Shah experiences significant heat loss while the condensate waits in the feed water tank to be fed back to the boiler.

The present invention utilizes the heat of the hot condensate water, which otherwise would be lost through dissipation to the air as low-pressure steam, for other applications. In contrast to the Shah patent, which is directed to a method for recapture of lost heat by preventing hot condensate water from flashing through an elaborate set-up of sophisticated equipments, the present invention prevents hot condensate from flashing by shifting the excessive heat for use to another system, such as a hot water heater, without the need for complicated equipments.

More generally, in systems wherein waste heat is typically recycled back into the boiler to improve the boiler efficiency, heat is still wasted at the stage when the process steam condenses to water and waits in the feed water tank to be pumped back into the boiler. While waiting in the feed water tank, heat dissipates into the environment. However, the heat energy that is lost from the hot condensate in the boiler system can be used for applications in other systems if it is captured before dissipation occurs. In the present invention, the waste heat energy recovered in the form of hot condensate feed water can be used to heat makeup water for a hot water tank.

For the foregoing reasons, there is a need for a method and apparatus for recovering waste heat in a boiler system that can be redirected for use in other applications, such as for use in a hot water tank.

SUMMARY OF THE INVENTION

The present invention is directed to an apparatus and method for the recovery of waste heat in a boiler system. An apparatus for waste heat recovery having the features of the present invention comprises a closed vessel, e.g. a boiler, for heating liquid under pressure to create steam. The closed vessel is connected generally by a steam supply pipe to a steam utilizing device, such as a turbine for generating power output, for example. In turn, the steam utilizing device is connected to a steam trap or condenser. The purpose of a steam trap is to keep steam in the system while removing condensate (water) and air, which can reduce the heat transfer ability of steam and cause corrosion. Condensate substantially reduces heat transfer and the ability of a steam device to do work.

The steam trap separates hot condensate from steam, which is collected as feed water in a feed water tank connected to the steam trap. A feed water pump connected to the feed water tank functions to pump the warm feed water back into the boiler. The boiler system as described in this invention is thus comprised of the cyclic process of the water heated in the boiler for application to a steam using device and returning to the boiler as warm feed water.

Because the boiler system experiences significant heat loss when the process steam condenses to water and waits in the feed water tank to be pumped back into the boiler, the waste heat can be recovered and applied for use in another system. For example, the recovery of waste heat can be used in a hot water tank system. A hot water tank system is an open system in which hot water from a hot water tank is consumed by use and consequently must be continually replenished. It is an objective of this invention to improve the thermal efficiency of the hot water tank system by applying the recovery of waste heat from the boiler system to facilitate the heating of water supplied to the hot water tank. This is accomplished through the interaction of the hot water tank system and the boiler system via a heat exchanger.

Therefore, an apparatus for waste heat recovery having the features of the present invention further comprises a heat exchanger, which is a device for transferring heat from one fluid to another, employed in the feed water tank of the boiler system. The heat exchanger has inlet and outlet connections to a hot water tank. The inlet connection from the heat exchanger to the hot water tank is bisected by a connection to a make-up water source, such as ground water.

A method for recovery of waste heat in a boiler system such as described herein comprises heating liquid under pressure in a closed vessel, e.g. a boiler, to create steam. The steam is applied to a steam utilizing device, e.g. a turbine. Over-flow steam and used vapor from the steam utilizing device is collected in a steam trap, which converts the steam vapor into condensate. The condensate from the steam trap is collected as warm feed water into a feed water tank, and then pumped from the feed water tank back into the boiler.

As described above, a heat exchanger is employed in the feed water tank. The heat exchanger is connected to a water supply vessel or hot water tank such that water is circulated into and out of the heat exchanger. A hot water tank is an appliance for heating water for other usage, in which a given amount of water is kept continuously hot and ready for use. As hot water from the hot water tank is consumed for usage, the supply must be continually replenished. The heat exchanger employed in the feed water tank functions to apply the recovery of waste heat from the boiler system to heating the water supplied to the hot water tank, thereby improving the thermal efficiency of the hot water tank system.

In an embodiment of the invention, the inlet connection from the heat exchanger to hot water tank is bisected by a connection to a make-up water source, e.g. ground city water. As hot water is consumed from the hot water tank, the make-up water mix with water cycled from the hot water tank. Since the city water is approximately ground temperature, the temperature of the mixed water is lower than the hot water consumed. As the mixed water from the hot water tank and make-up water source flows through the heat exchanger, the mixed water is heated by the warm feed water in the feed water tank. The heated mix water then circulate out of the heat exchanger back into the hot water tank for use. In this way, the supply of hot water in the hot water tank is replenished for use by the heated mix water.

There are several advantages to the present invention. The need for hot water is one of the most common utilities for any building. By using recovered waste heat from a boiler for use in a hot water tank, hot water is provided in an economically efficient method. As described above, this is achieved by the simple use of a heat exchanger between an existing boiler feed water system and conventional hot water heater system. The heat exchanger functions to provide efficient heat transfer from feed water to make-up water, thereby pre-heating the make-up water to the hot water tank.

The thermal efficiency of the apparatus and method described herein can be further increased by the use of insulating material for the boiler feed water tank to prevent heat lost. In addition, temperature control of the hot water tank can be accomplished by a circulation pump control.

DETAILED DESCRIPTION

Figure 1:
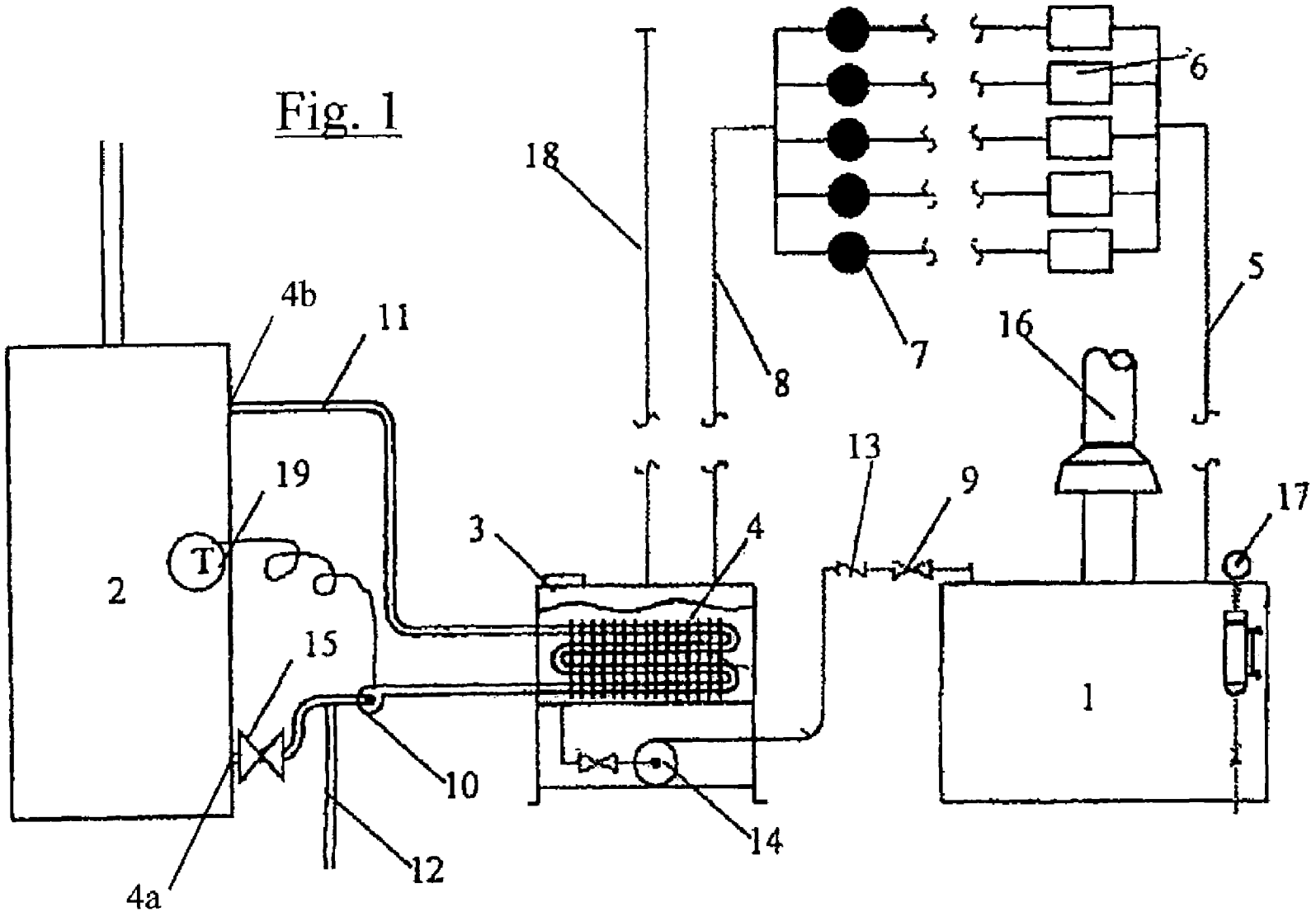
FIG. 1 is a schematic diagram of an embodiment of the invention.

Referring to FIG. 1, an apparatus for waste heat recovery comprises a closed vessel 1 (e.g. a boiler), for heating liquid under pressure to create steam. The closed vessel 1 can be any type of boilers, including (but not limited to) for example conventional gas boilers, condensing boilers, combination boilers, and other types of oil or electric boilers. Typically, a boiler as depicted by closed vessel 1 in FIG. 1 has a pressure gage 17 for modulating the pressure and an exhaust pipe 16.

Closed vessel 1 is connected by a steam supply pipe 5 to a steam utilizing device 6. A steam utilizing device 6, for example, can be a turbine for extracting energy of the pressurized steam to generate power output.

In turn, the steam utilizing device 6 is connected to a steam trap 7 (e.g. condenser). The steam trap 7 separates steam from hot condensate, which is collected as warm feed water in a feed water tank 3 connected to steam trap 7 via condensate steam pipe 8. A feed water pump 14 connected to feed water tank 3 functions to pump the warm feed water back into the closed vessel 1. A heat exchanger 4, having inlet and outlet connections 4*a* and 4*b* to a hot water tank 2, is employed in the feed water tank 3. In a preferred embodiment of the invention, heat exchanger 4 has an inlet connection to the lower end of water tank 2, to enable drawing of water from hot water tank 2. The water drawn from hot water tank 2 can be mixed with make-up water 12 from a ground water source, for example.

As shown in FIG. 1, a method for recovery of waste heat such as described herein comprises heating liquid under pressure in closed vessel 1 to create steam. The pressurized steam from closed vessel 1 is transmitted to a steam utilizing device 6 via steam supply pipe 5. The transmitted steam is applied to a steam utilizing device 6. Steam and vapor from the steam utilizing device 6 is collected in a steam trap 7, which separates the steam vapor from condensate. The condensate from the steam trap 7 is transmitted to feed water tank 3 via condensate steam pipe 8. The condensate is collected as warm feed water into feed water tank 3, having relief 18. Feed water tank 3 also has feed water pump 14 for pumping the warm feed water from the feed water tank back 3 into the closed vessel 1, the process modulated by check valve 13 and check valve 9.

A heat exchanger 4 is employed in feed water tank 3. The heat exchanger 4 is connected to a hot water tank 2 (i.e. a water supply vessel) such that water from hot water tank 2 flows into heat exchanger 4, the flow of water modulated by check valve 15. In an embodiment of the invention, the inlet connection 4*a* of the heat exchanger 4 is connected to the lower end of said hot water tank 2 and outlet connection 4*b* is connected to the upper end of said hot water tank 2 via hot water circulation pipe 11. The inlet connection 4*a* of heat exchanger 4 to hot water tank 2 is bisected by a connection to a make-up water 12 source, which supplies additional in-flow of water through circulation pump 10 to heat exchanger 4. As the mixed water from hot water tank 2 and make-up water 12 source flows through the heat exchanger 4, the mixed water is heated by the warm feed water in the feed water tank 3. The heated water then circulates out of heat exchanger 4 back into hot water tank 2 via hot water circulation pipe 11. Hot water tank 2 has thermostat 19 that controls circulation pump 10, according to the hot water temperature.

What is claimed is:

1. An apparatus for recovery of waste heat in a boiler system comprising:

a closed vessel for heating liquid under pressure to create steam;

said closed vessel connected to a steam utilizing device;

said steam utilizing device connected to a steam trap;

said steam trap capable of separating steam after use by said steam utilizing device from condensate;

said steam trap connected to a feed water tank capable of receiving said condensate from said steam trap;

said feed water tank connected to a feed water pump for pumping said condensate as feed water back into said closed vessel;

said feed water tank having a heat exchanger therein;

said heat exchanger having inlet and outlet connections to a water supply vessel, wherein said heat exchanger is capable of cycling water from and to said water supply vessel, such that said water cycled through the heat exchanger is not returned to said closed vessel;

whereby heat loss when said feed water waits in said feed water tank to be pumped back into said closed vessel can be recovered to be applied for heating water cycled through said heat exchange from and to said water supply vessel.

2. The apparatus according to claim 1, wherein said closed vessel further having a pressure gage and exhaust pipe.

3. The apparatus according to claim 1, wherein said closed vessel is connected to said steam utilizing device via a steam supply pipe.

4. The apparatus according to claim 1, wherein said steam trap is connected to said feed water tank via a condensate steam pipe.

5. The apparatus according to claim 1, wherein said feed water pump is connected to a check valve for regulating return of said feed water to said closed vessel.

6. The apparatus according to claim 1, wherein said inlet connection of said heat exchanger is connected to an end of said water supply vessel.

7. The apparatus according to claim 1, wherein said outlet connection of said heat exchanger is connected to an end of said water supply vessel.

8. The apparatus according to claim 7, wherein said outlet connection of said heat exchanger is connected to an end of said water supply vessel via a hot water circulation pipe.

9. The apparatus according to claim 1, wherein said inlet connection of said heat exchanger to said water supply vessel is bisected by connection to a make-up water source.

10. The apparatus according to claim 1, wherein a circulation pump is connected in relation to said inlet connection of said heat exchanger bisected by connection to a make-up water source.

11. The apparatus according to claim 10, wherein said water supply vessel has thermostat located thereon for regulating said circulation pump.

12. A method for recovery of waste heat in a boiler system comprising:

heating liquid under pressure in a closed vessel to create steam;

applying said steam to a steam utilizing device;

collecting steam after use by said steam utilizing device in a steam trap;

separating said steam from condensate in said steam trap;

collecting said condensate from said steam trap as feed water into feed water tank;

pumping said feed water back into said closed vessel;

cycling water from a water supply vessel into heat exchanger located in said feed water tank, so as to permit heat transfer between said feed water in said feed water tank with said water from said water supply vessel in flow through said heat exchanger;

cycling water from heat exchanger back into said water supply vessel;

wherein heat loss recovered when said feed water waits in said feed water tank to be pumped back into said closed vessel can be applied to heating water cycled through said heat exchange to said water supply vessel.

13. In a method for recovering waste heat in a boiler system, of the type wherein liquid is heated under pressure in a closed vessel to create steam, said steam applied to a steam utilizing device, said steam after use by said steam utilizing device collected in a steam trap, said steam converted into condensate in said steam trap, said condensate collected from said steam trap as feed water into a feed water tank, said feed water pumped back into said closed vessel, the improvement comprising:

providing a heat exchanger in said water feed tank so that water cycled through said heat exchanger can be warmed by heat from water in said feed water tank.

* * * * *